US008309198B2

(12) United States Patent
Bell et al.

(10) Patent No.: US 8,309,198 B2
(45) Date of Patent: Nov. 13, 2012

(54) RUGS WITH A MAT PORTION

(75) Inventors: Jeneva Bell, Las Vegas, NV (US); Sarah Prinsloo, Miami, FL (US)

(73) Assignee: Product Bliss, LLC, Henderson, NV (US)

( * ) Notice: Subject to any disclaimer, the term of this patent is extended or adjusted under 35 U.S.C. 154(b) by 0 days.

(21) Appl. No.: 12/699,524

(22) Filed: Feb. 3, 2010

(65) Prior Publication Data

US 2011/0195219 A1 Aug. 11, 2011

Related U.S. Application Data

(60) Provisional application No. 61/252,859, filed on Oct. 19, 2009.

(51) Int. Cl.
*A47G 27/02* (2006.01)

(52) U.S. Cl. ..... 428/100; 428/99; 428/141

(58) Field of Classification Search ..... 428/99, 428/141, 156, 195.1, 95, 100; 5/420, 417; 482/23

See application file for complete search history.

(56) References Cited

U.S. PATENT DOCUMENTS

| | | | |
|---|---|---|---|
| 2,721,818 | A | 10/1955 | Dolnick et al. |
| 2,975,089 | A | 3/1961 | Hargreaves |
| 4,018,260 | A | 4/1977 | Baslow |
| 4,053,008 | A | 10/1977 | Baslow |
| 4,137,584 | A | 2/1979 | Sharber |
| 4,151,762 | A | 5/1979 | Baslow |
| 4,161,977 | A | 7/1979 | Baslow |
| 4,189,880 | A | 2/1980 | Ballin |
| 4,197,686 | A | 4/1980 | Baslow |
| 4,336,293 | A | 6/1982 | Eiden |
| 4,348,447 | A | 9/1982 | Miller, Jr. et al. |
| 4,504,537 | A | 3/1985 | Mussallem, Jr. |
| 4,596,729 | A | 6/1986 | Morrison |
| 4,709,430 | A | 12/1987 | Nicoll |
| 4,726,084 | A | 2/1988 | Keserovich et al. |
| 4,762,741 | A | 8/1988 | Hedley |
| 4,860,777 | A | 8/1989 | Orlando |

(Continued)

FOREIGN PATENT DOCUMENTS

EP 0177664 A1 4/1986

(Continued)

OTHER PUBLICATIONS

English language abstract of Japanese Patent Publication No. 08-085150 published on Apr. 2, 1996.

(Continued)

*Primary Examiner* — Alexander Thomas
(74) *Attorney, Agent, or Firm* — Cantor Colburn LLP

(57) ABSTRACT

A rug is configured from a cover attached to an underlying, non-slip, non-absorbent mat by an interlocking mechanical connection. The interlocking mechanical connection is formed in a first embodiment by hook and loop material of the type sold under the trademark VELCRO, and in a second embodiment by a layer of grit material on the mat, and in a third embodiment by a resinous material which has projections that interlock with the bottom surface of the cover. When it is desired to separate the cover from the mat, the cover is simply pulled and stripped away from the mat so that the cover may be washed in a washing machine and the mat may also be manually washed or otherwise cleaned. If desired, the cover may be replaced with covers of different designs or textures.

14 Claims, 10 Drawing Sheets

U.S. PATENT DOCUMENTS

| | | | | |
|---|---|---|---|---|
| 4,999,866 | A | 3/1991 | Lindsey | |
| 5,117,598 | A | 6/1992 | Livingston et al. | |
| 5,154,961 | A | 10/1992 | Reuben | |
| 5,203,041 | A | 4/1993 | Alonso | |
| 5,214,892 | A | 6/1993 | Livingston et al. | |
| 5,236,753 | A | 8/1993 | Gaggero et al. | |
| 5,362,544 | A | 11/1994 | Reuben | |
| 5,473,785 | A | 12/1995 | Lager et al. | |
| 5,592,721 | A | 1/1997 | Zeller | |
| 5,620,546 | A | 4/1997 | Reuben | |
| 5,711,336 | A | 1/1998 | Nirmel | |
| 5,715,638 | A | 2/1998 | Anderson, Sr. | |
| 5,763,040 | A | 6/1998 | Murphy et al. | |
| 5,787,527 | A | 8/1998 | Anderson | |
| 5,942,311 | A | 8/1999 | Scianna | |
| 5,953,873 | A | 9/1999 | Livingston et al. | |
| 5,997,995 | A | 12/1999 | Scianna | |
| 6,027,781 | A | 2/2000 | Landry et al. | |
| RE36,677 | E | 5/2000 | Reuben | |
| 6,065,164 | A | 5/2000 | Swanger et al. | |
| 6,114,002 | A | 9/2000 | Rinaldo | |
| 6,200,662 | B1 | 3/2001 | Mussallem, III | |
| 6,224,962 | B1 | 5/2001 | Young, III | |
| 6,399,181 | B1 | 6/2002 | Corder | |
| 6,408,461 | B2 | 6/2002 | Zheng | |
| 6,450,886 | B1 | 9/2002 | Oishi et al. | |
| 6,576,577 | B1 | 6/2003 | Garner | |
| 6,610,382 | B1 * | 8/2003 | Kobe | 428/119 |
| 6,613,113 | B2 | 9/2003 | Minick et al. | |
| 6,663,537 | B2 | 12/2003 | McCoy | |
| 6,751,816 | B1 | 6/2004 | Wechsler | |
| 6,920,655 | B2 | 7/2005 | Mitchell | |
| 6,961,969 | B2 | 11/2005 | Nichols | |
| 7,001,318 | B2 | 2/2006 | Su-Tuan | |
| 7,051,389 | B2 | 5/2006 | Wassilefky | |
| 7,069,607 | B2 | 7/2006 | Nichols | |
| 7,083,486 | B2 | 8/2006 | Yeh | |
| 7,235,114 | B1 | 6/2007 | Minick et al. | |
| 7,279,058 | B2 | 10/2007 | Morgan | |
| 7,306,840 | B2 | 12/2007 | Brade-Scholz et al. | |
| 7,415,742 | B2 | 8/2008 | Wassilefsky | |
| 7,464,791 | B2 | 12/2008 | Cooksey et al. | |
| 7,530,127 | B2 | 5/2009 | Leifermann et al. | |
| 7,735,169 | B2 | 6/2010 | Wassilefsky | |
| 7,850,498 | B2 | 12/2010 | Yeh | |
| 7,976,933 | B2 | 7/2011 | Yeh | |
| 2004/0013853 | A1 | 1/2004 | Mandzsu et al. | |
| 2004/0250346 | A1 | 12/2004 | Vasishth | |
| 2005/0101201 | A1 | 5/2005 | Yeh | |
| 2006/0134401 | A1 | 6/2006 | Yeh | |
| 2007/0110950 | A1 | 5/2007 | Yang | |
| 2007/0275827 | A1 | 11/2007 | Glaser | |
| 2008/0152860 | A1 | 6/2008 | Meyer | |
| 2008/0305304 | A1 | 12/2008 | Yeh | |
| 2009/0148666 | A1 | 6/2009 | Yeh | |
| 2009/0162579 | A1 | 6/2009 | McDuff | |
| 2009/0258179 | A1 | 10/2009 | Sudol et al. | |
| 2011/0052877 | A1 | 3/2011 | Yeh | |

FOREIGN PATENT DOCUMENTS

| | | | |
|---|---|---|---|
| GB | 2115693 | A | 9/1983 |
| JP | 08-85180 | A | 4/1996 |
| JP | 2002-337592 | | 11/2002 |
| KR | 10-2006-0098189 | A | 9/2006 |
| WO | 2008/011708 | A1 | 1/2008 |

OTHER PUBLICATIONS

English language abstract of Japanese Patent Publication No. 2002-337592 published on Nov. 27, 2002.

International Search Report and Written Opinion for International Application No. PCT/US2010/040821, international filing date of Jul. 1, 2010, mailed Feb. 28, 2011, 9 pages.

* cited by examiner

RUGS WITH A MAT PORTION

CROSS-REFERENCE TO RELATED APPLICATION

This application claims the benefit of the filing date of U.S. Provisional Application Ser. No. 61/252,859 filed Oct. 19, 2009, which is incorporated by reference herein.

BACKGROUND OF THE INVENTION

1. Field of the Invention

The present invention relates to rugs with a mat portion. More particularly, the present invention relates to rugs with a mat portion for, but not limited to, rugs being used as area rugs, throw rugs, floor runners, bath mats, door mats and rugs configured for use as floor, kitchen, door, car, exercise, play, and pet mats as well as any other types of rugs.

2. Related Art

Rugs are typically made of carpet fibers or other fibrous material that is difficult to clean thoroughly or sanitize. When soiled, the rug must be scrubbed by hand or professionally cleaned like carpet, and may still be left with residue stains or soil marks and odor from food, drink or other liquid, dirt, mold, mildew, allergens, toxins, pet dander, pet or human vomit, urine, or other bodily fluids. The nature of a typical rug design and construction makes it time-consuming or costly to clean or replace, heavy and cumbersome to move, and nearly impossible to thoroughly clean. Professional cleaning may use toxic chemicals, and steam cleaning cannot reach deep in the fibers. This may be hazardous to children who crawl or anyone who lies on the rug, or to any person sensitive to allergens, odors and toxins. Typical rugs or doormats are not designed to be laundered in a washing machine, cleaned thoroughly with soap and water or dry cleaned. Rugs typically require a separate rug pad made from a non-slip material. This pad needs to be trimmed so that it is slightly smaller than the rug and is placed under the rug. There is no satisfactory attachment mechanism; therefore, the rug and underlying pad often separate, leaving the rug shifted and the pad exposed. Standard bath mats are designed in two ways; one way is similar to a heavy towel so it is washable, but without a non-slip feature it can be hazardous. The other way is a bath mat manufactured with a fibrous, absorbent top and built-in non-slip backing. It claims to be washable, but once laundered in a washing machine, it typically starts falling apart, leaving chunks of loose fibers and bits of the non-slip backing in the washing machine. Moreover, the cumbersome, difficult and expensive nature of a typical rug prevents it from being versatile, e.g., it does not allow the owner to switch out the rug design seasonally or as desired or needed, as is often the case with bedding. Often, owners will keep a soiled rug longer than desired because of the inconvenience and expense of replacement. Typical rugs are made with wool fiber that, in addition to trapping the above-mentioned stains and soil, can shed, be itchy and uncomfortable. Alternative rug options, such as rugs made from natural fibers such as sisal, are rough and uncomfortable to walk, crawl or lie on, and are also heavy and difficult to clean. Rugs made from plastics that are designed for outdoor use are washable with soap and water but are essentially all plastic and, therefore, uncomfortable and limited to a few basic designs.

Accordingly, there is a need for a rug or bath mat that serves the purpose of a conventional rug, carpet or bath mat, but is configured to enable the owner to separate a fabric cover material from a non-slip, non-absorbent mat material and wash both separately with minimal cost or inconvenience.

Moreover, there is a need for a rug alternative that is lighter in weight, comfortable, versatile, flexible, bendable (more compact) and, therefore, less cumbersome to carry or move, and less prone to accumulation of dirt, dust, mold, mildew, pet dander, allergens, residual stains, pet or human vomit, urine or other bodily fluids.

SUMMARY OF THE INVENTION

In view of the aforementioned considerations, the present invention is directed to rugs, or mats as in a bath mat, with a non-slip, non-absorbent mat portion detachably fastened to a cover portion by a releasable fastening means for mechanically interlocking the mat to the cover portion.

In accordance with a first embodiment of the rug, when a rug of the present invention is mounted on a floor, the rug provides a cover with a first top surface which is visible and a first bottom surface which is hidden, the first bottom surface having a first peripheral area and a first central area. The cover cooperates with a mat providing thereon a second top surface and a second bottom surface, the first and second bottom surfaces being substantially planar. The second bottom surface has a second peripheral area and a second central area when a sliding force is applied to the cover and the mat, the second top and bottom surfaces provided by the mat expose non-slip material for frictionally gripping both the first bottom surface of the cover and the exposed surface of the floor. A peripheral fastening arrangement on or in the second peripheral area of the mat detachably connects the first peripheral area provided on the underside of the cover to the second peripheral area provided on the mat with a holding force operative transverse to the sliding force. The peripheral fastening arrangement keeps the cover and the mat connected until it is desired to separate the cover from the mat. Consequently, when the cover and mat are attached at their peripheral areas and lying on a floor, footsteps on the first top surface provided on the cover cause the first bottom surface of the cover to frictionally engage the second top surface on the mat. Accordingly, during use of the rug on a floor, the cover does not slip relative to the mat and the mat does not slip relative to the floor. When the rug is due for cleaning or laundering, the cover is strippable from the mat by applying a force that separates the peripheral fasteners.

In a further aspect of the rug of the invention, the fastener of the second peripheral area on the mat is comprised of a hook portion of hook and loop fasteners of the type sold under the trademark VELCRO. Reference herein to the trademark "VELCRO" means the hook or loop portion or both, as specified or as the context requires, of such hook and loop fasteners. The VELCRO hooks on the second peripheral area engage fabric of the cover exposed at the first peripheral area of the cover.

In a further aspect of the rug of the invention, wherein the fastener of the second peripheral area provided on the mat is comprised of one of VELCRO hooks or loops and the first peripheral area defined on the cover is a second fastener comprised of the other of loops or hooks, which loops or hooks couple with the hooks or loops, respectively, of the fastener on the second peripheral area on the mat.

In a further aspect of the rug of the invention, the fasteners are VELCRO® fasteners.

In a further aspect of the rug of the invention, the mat material is formed of foam, more specifically, polyester knit coated with polymers of polyvinylchloride in primary form, plasticized, that provides a non-slip coating on the foam.

In a further aspect of the rug of the invention, the polyester knit is coated with plasticized polymers of polyvinylchloride in primary form on the second top and bottom surfaces provided by the mat.

In a further aspect of the rug of the invention, the cover is typically made from fabric with the similar attributes of polyester, namely, non-shrink, non-wrinkle, non-stretch, washable and durable, and in some cases a non-toxic stain resistant coating, the first top surface is coated with polypropylene and the first bottom surface is coated with polypropylene, or otherwise treated for stain resistance, unless the rug is used as a bath mat or any other type of mat in which case cotton, microfiber, or any other type of material may be typical.

In a further aspect of the rug of the invention, a variety of cover designs and textures are selectable to combine with the mat to make rugs of various aesthetic designs or rugs for various purposes.

An embodiment of the invention is directed to a mat for supporting a cover that with the mat, forms a rug for covering a floor. The mat comprises substantially planar top and bottom surfaces of non-slip material and a peripheral area on the top surface disposed around a central area of the top surface to provide a central non-slip area for engaging a selected cover. One portion of a two-portion VELCRO hook and loop fastening material is attached to the peripheral area for detachably attaching a selected cover thereto, wherein the portion of the fastening material stabilizes a cover attached to the mat while the non-slip material resists sliding of a cover with respect to the mat and sliding of the mat with respect to the floor.

In a further aspect of the mat, the portion of hook and loop material on the mat is the hook portion.

In a further aspect of the mat, the portion of hook and loop material on the mat is the loop portion.

In still a further aspect of the mat, the mat is formed of polyester-coated foam with a non-slip material.

In still a further aspect of the mat, the polyester is in the form of a polyester knit and the non-slip material is polyvinylchloride located on the top and bottom surfaces of the mat.

In a second embodiment of the rug of the invention, the mat is coated with a grit material of particulate elements which mechanically interlock with the bottom surface of the cover to retain the cover on the mat.

In a third embodiment of the invention the mat has a resinous film or coating applied to the mat which film or coating mechanically interlocks with the cover to form the rug.

Yet another embodiment of the invention provides a rug for covering a floor, the rug comprising a cover having a top surface and a bottom surface, and a mat having a top surface for facing the bottom surface of the cover and a non-slip bottom surface for facing the floor. A releasable fastening material provides for interlocking the bottom surface of the cover to the top surface of the mat to releasably attach the cover to the mat, and to prevent the cover from slipping relative to the mat, the cover being manually strippable from the mat.

BRIEF DESCRIPTION OF THE DRAWINGS

Various other features and attendant advantages of the present invention will be more fully appreciated as the same becomes better understood when considered in conjunction with the accompanying drawings, in which the reference characters designate the same or similar parts throughout the several views, and wherein.

DETAILED DESCRIPTION OF SPECIFIC EMBODIMENTS OF THE INVENTION

FIGS. 1-6

First Embodiment

Figure 1:
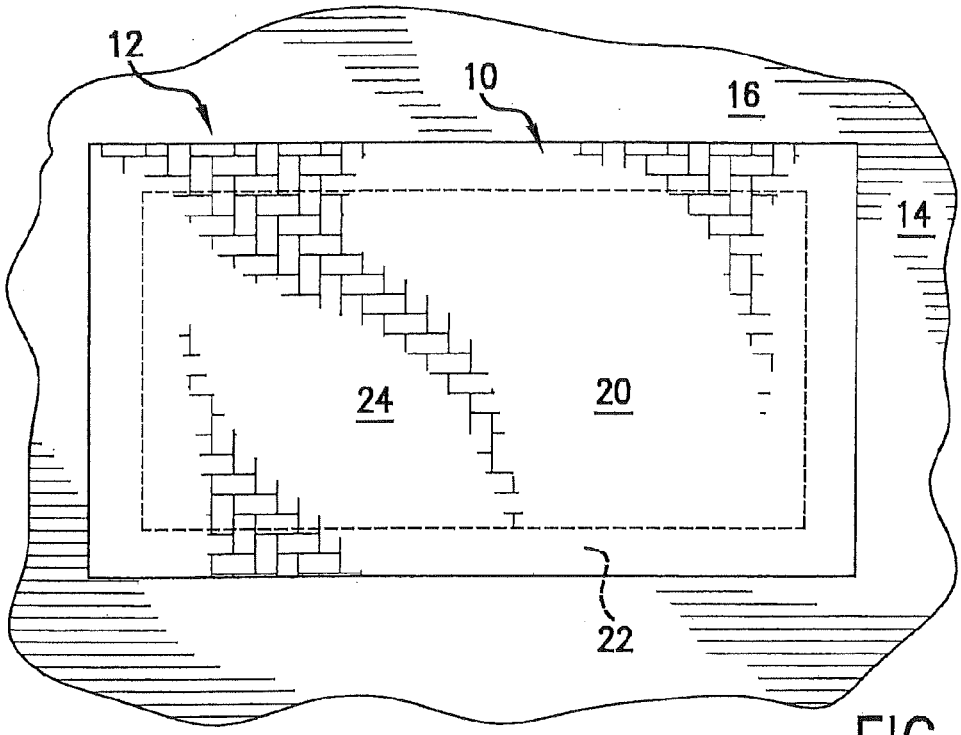
FIG. 1 is a top view of a rug according to a first embodiment of the present invention and comprising a cover and a mat, the rug resting on a floor with only the cover portion of the rug visible.

Referring now to FIG. 1 there is shown a cover 10 of a rug 12 lying on the top surface 14 of a floor 16. The cover 10 provides a first top surface 20 when the rug lies on the surface 14 of the floor 16. The first top surface 20 may be decorative, as is the case in almost all rugs or mats which serve as carpets in homes, offices and other buildings. The first top surface 20 of the rug 12 may also be utilitarian when used for bath mats, kitchen mats, exercise mats, pet mats, yoga mats or any other kind of mat. The first top surface 20 has a top peripheral area 22 and a first central area 24 surrounded by the peripheral area 22. The peripheral area 22 may be discernable in the aesthetic design to an observer or not discernable from the aesthetic design of the first top surface 20. As will be explained hereinafter, the portion of the underside of the cover 10 beneath the peripheral area 22 is used to detachably couple the cover 10 to a second top surface 30 of a mat 32 shown in FIGS. 2, 4 and 5 in order to provide the rug 12 of the present invention.

Figure 2:
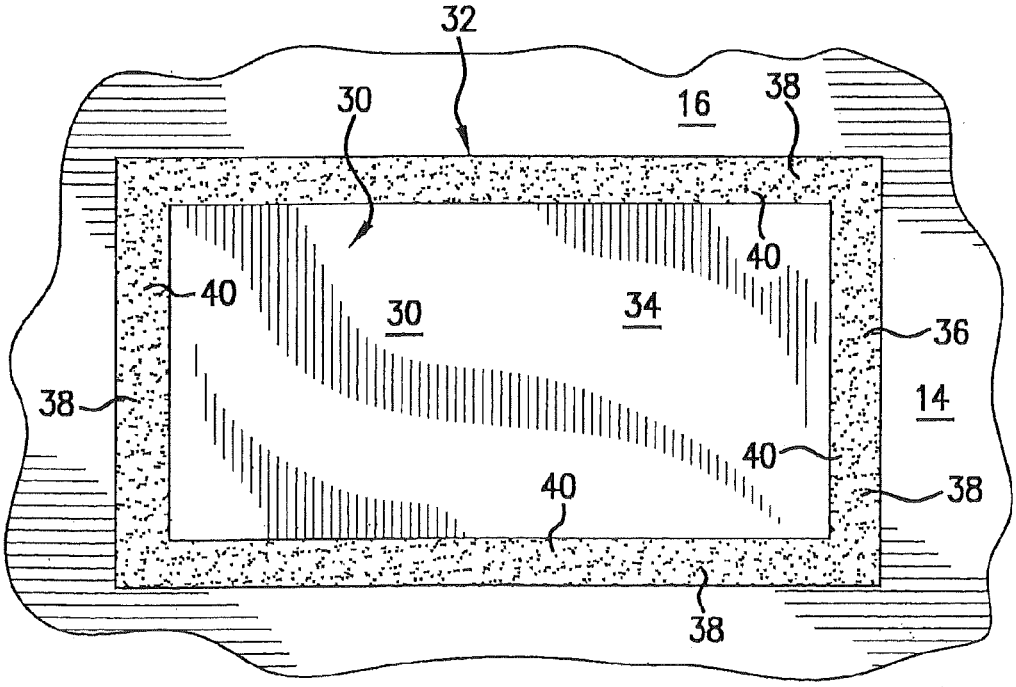
FIG. 2 is a top view of the mat of the rug of FIG. 1 resting on the floor and with the cover portion removed.

Referring now to FIG. 2, the mat 32 providing thereon a second top surface 30 is shown with the cover 10 of FIG. 1 removed. The mat 32 rests directly on the surface 14 of the floor 16 and is made of flexible resilient material or materials so as to provide non-slip characteristics with respect to both the surface 14 of the floor 16 and the cover 10. The second top surface 30 has a non-slip texture at least over a second central area 34 of the mat 32 to help prevent the first central area 24 of the cover 10 from slipping with respect to the second central area 34 on the mat 32. Disposed around the second central area 34 of the mat 32 is a second peripheral area 36 that aligns with the first peripheral area 22 of the cover 10. Fixed to the second peripheral area 36 is a releasable fastener 38, preferably in the form of the hooks or loops of a VELCRO® strip 40. While it is preferable that the VELCRO® strip 40 completely fill the second peripheral area 36, in one embodiment, the VELCRO® strip may have breaks or VELCRO®-free spaces, or may expand beyond the second peripheral area 36 in a striped, criss-crossed or diagonal fashion if necessary to still operate effectively in accordance with the principles of the present invention. Moreover, the thickness of the VELCRO peripheral area may vary as can the distance from the edge of the mat 32 to the start of the second peripheral area 36.

Figure 3:
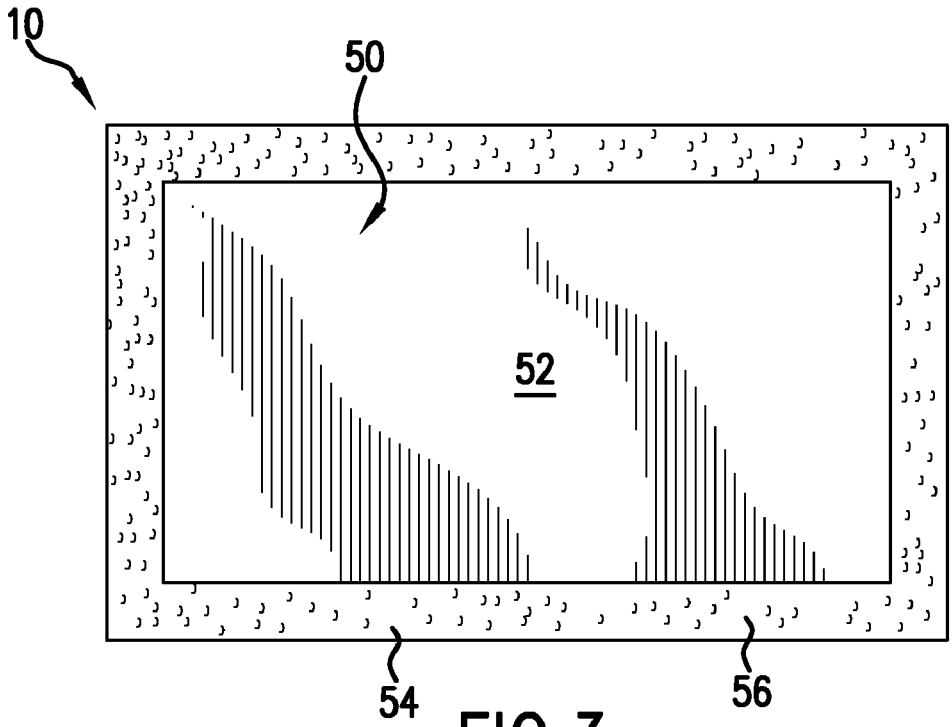
FIG. 3 is a bottom view of the cover of the rug of FIG. 1.

Referring now to FIG. 3, the bottom view of the cover 10, which in most situations will not have an aesthetic design, except where the cover 10 is reversible, presents a first bottom surface 50 of cover 10. The first bottom surface 50 has a first central area 52 surrounded by a first peripheral area 54 which is aligned with and beneath the top peripheral area 22 of the cover 10 when the cover 10 and mat 32 are arranged. In a preferred embodiment, the first peripheral area 54 provided on the underside of the cover 10 has a second fastening portion 56 of the two-part VELCRO® fastener 40 secured thereto by stitching, bonding or adhesion wherein loops or hooks are operating with the hooks or loops provided in the fastener strip 38 on the mat 32. Thus, the first bottom surface 50 of the cover 10 is releasably attached to the second top surface 30 of the mat 32 with the first central area 52 of the cover 10 in alignment with the second central area 34 of the mat 32.

Figure 4:
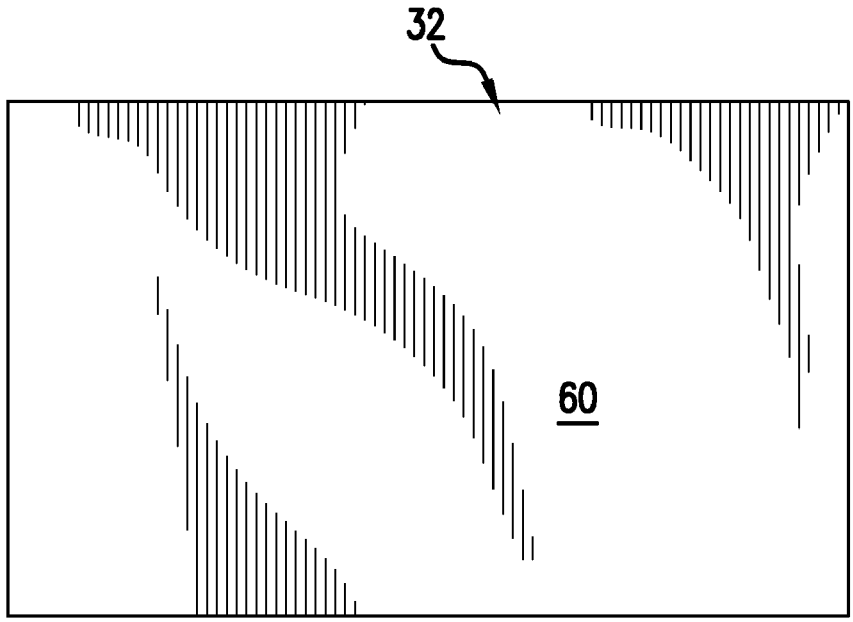
FIG. 4 is a bottom view of the mat of the rug of FIG. 1.

Referring now to FIG. 4, the mat 32 provides a second bottom surface 60 that is preferably planar and, when the rug is laid on the top surface 14 of the floor 16 as is seen in FIGS. 1 and 2, abuts the floor 16 in a non-slip relationship.

Figure 5:
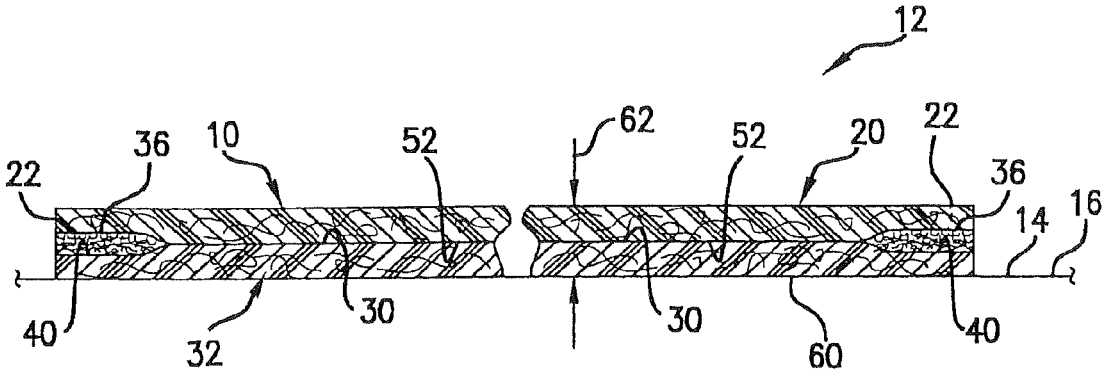
FIG. 5 is a side elevation view of the rug of FIG. 1 showing force applied to the rug by a footstep.

As is seen in FIG. 5 where the rug 12 is shown in cross-section, it is seen that when the rug 12 is assembled and on the floor 16, foot pressure represented by the arrow 62, is transmitted through the first top surface 20 and the first bottom surface 50 of the cover 10 to the non-slip second top surface 30 of the mat 32. This causes the cover 10 to frictionally adhere to the mat 32 so that the cover 10 does not slip with respect to the mat 32. The same foot pressure force 62 is transmitted from the second top surface 30 of the mat 32 to the second bottom surface 60 of the mat 32 so that the second bottom surface 60 frictionally engages the top surface 14 of the floor 16. Consequently, the mat 32 and the cover 10 help prevent slippage with respect to one another and with respect to the floor 16. Consequently, the rug 12 does not slip with respect to the floor 16.

When there is no vertical pressure on the rug 12 caused by walking on the rug or otherwise applying vertical pressure to the first top surface 20 of the cover 10 of the rug 12, the cover 10 and the mat 32 remain aligned when assembled due to peripheral fastening provided by the hooks and loops of the VELCRO® fasteners 40 on the opposed peripheral portions 36 and 54 of the cover 10 and mat 32.

Figure 6:
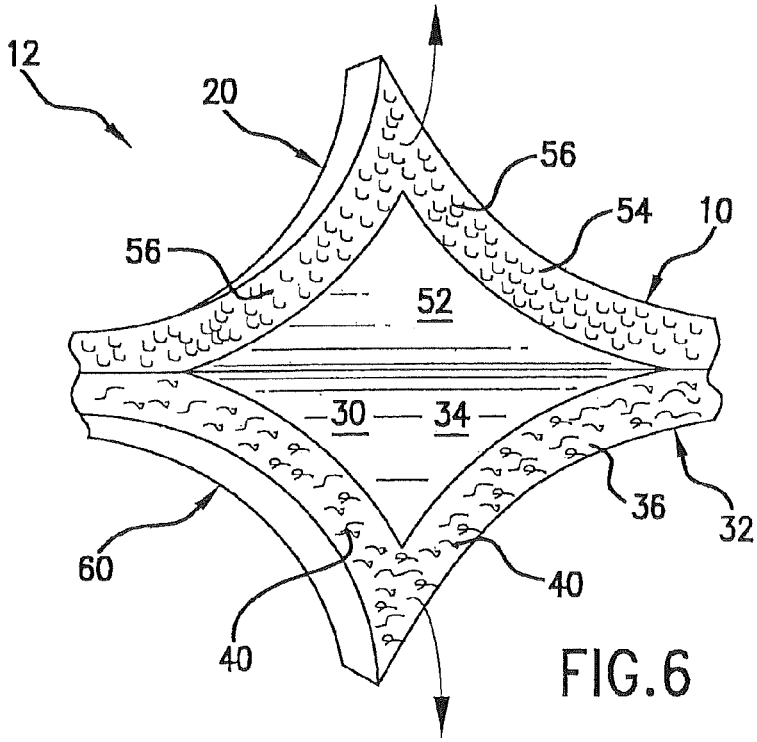
FIG. 6 is a side perspective view of the cover and the mat of the rug of FIG. 1 with the cover and mat being separated.

Referring now to FIG. 6, when it is necessary to separate the cover 10 from the mat 32 in order to launder the cover 10 and/or manually clean the non-absorbent mat 32, the cover 10 is stripped from the mat 32 by simply grasping the cover 10 in one hand and the mat 32 in the other and pulling them apart to separate the VELCRO® fastener 40. The cover 10 may then be separately laundered in a washing machine or otherwise cleaned. The mat 32 may be cleaned separately with a non-bleach household cleanser or soap and water.

It may be desired to switch or replace the cover 10 so as to have a new design of the cover 10 as the seasons change, to provide a room with a fresh look, or to simply replace the old cover with a new cover. This feature is accommodated by having a plurality of interchangeable covers 10 for each mat 32.

In a current embodiment of the invention, the mat 32 is formed of polyester-coated foam with a non-slip material, for example, the polyester may be in the form of a polyester knit. Preferably, the non-slip material is polyvinylchloride disposed on the second top surface 30 and second bottom surface 60 of the mat 32. In the current embodiment of the invention, the second top surface 30 provided on the mat 32 is relatively smooth, whereas the textured or scrim side is on the second bottom surface 60 (FIG. 3) provided by the mat 32. The smoother side therefore is in contact with the first bottom surface 50 of cover 10 and the textured or scrim side is in contact with the floor 16.

While polyester is the preferred material for the mat 32, an eco-friendly material that is soybean-based may be used rather than a petroleum-based plastic, or natural rubber, or any other new material with similar attributes.

While a plethora of materials may be used for the cover 10, a presently preferable cover 10 has a fiber content which is substantially polyester which, on the first top surface 20 of the cover 10, is coated with polypropylene so as to be non-toxic, non-bleed and stain resistant. The first bottom surface 50 of the cover 10 has a polypropylene coating which makes the fabric stronger.

FIGS. 7-12

Second Embodiment

Figure 7:
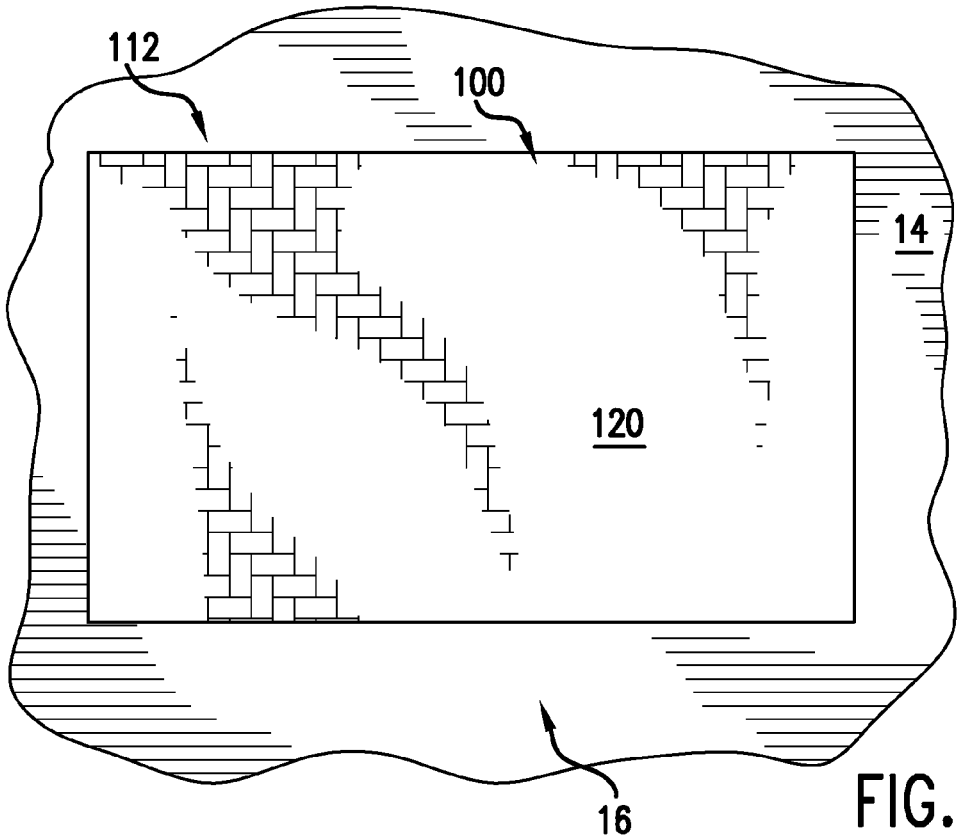
FIG. 7 is a top view of a rug according to a second embodiment of the present invention and comprising a cover and a mat, the rug resting on a floor with only the cover visible.

Referring now to FIG. 7 there is shown a cover 100 of a rug 112 lying on the top surface 14 of a floor 16. The cover 100 provides a first top surface 120 when it lies on the surface 14 of the floor 16. The first top surface 120 may be decorative, as is the case in almost all rugs or mats which serve as carpets in homes, offices and other buildings. The first top surface 120 of the rug 112 may also be utilitarian when used for bath mats, kitchen mats, exercise mats, pet mats, yoga mats or any other kind of mat.

Figure 8:
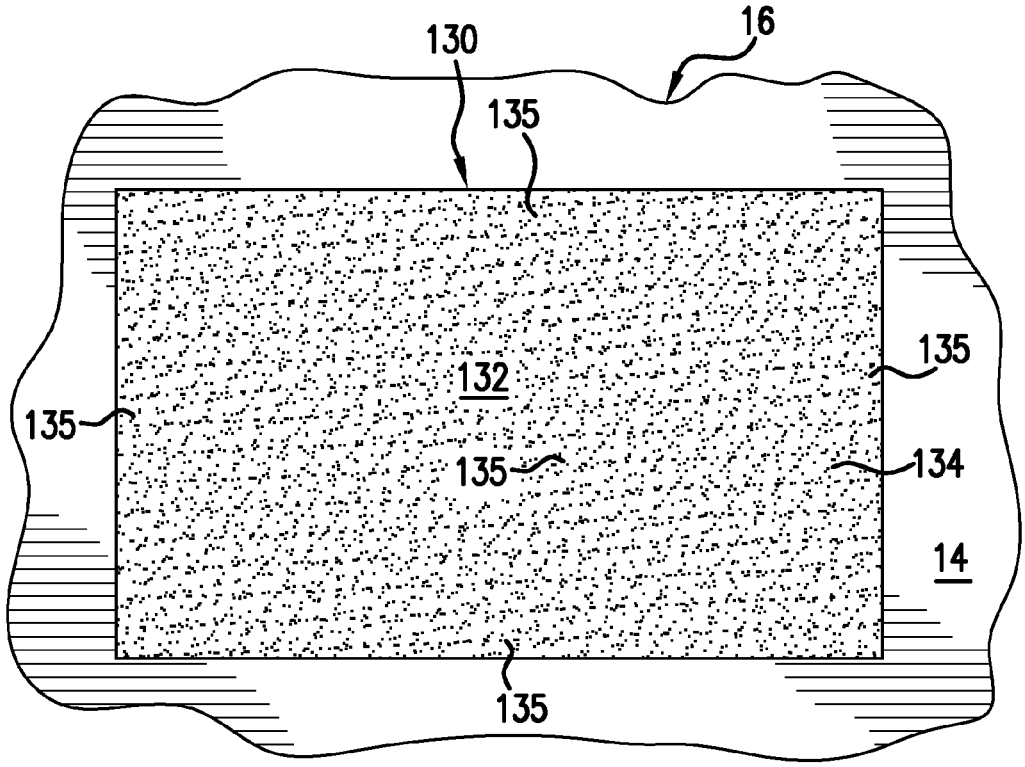
FIG. 8 is a top view of the mat of the rug of FIG. 7, the mat resting on the floor with the cover portion removed.

Referring now to FIG. 8, a mat 130 having a second top surface 132, is shown with the cover 100 of FIG. 7 removed by being stripped therefrom. The mat 130 rests directly on the surface 14 of the floor 16 and is made of flexible resilient material or materials that provide non-slip characteristics with respect to both the surface 14 of the floor 16 and the cover 100. The second top surface 132 of the mat 130 has grit material 134 thereon comprised of particles 135 that mechanically engage the first bottom surface 140 of the cover 100 to prevent the cover 100 from slipping with respect to the second top surface 132 of the mat 130.

Figure 9:
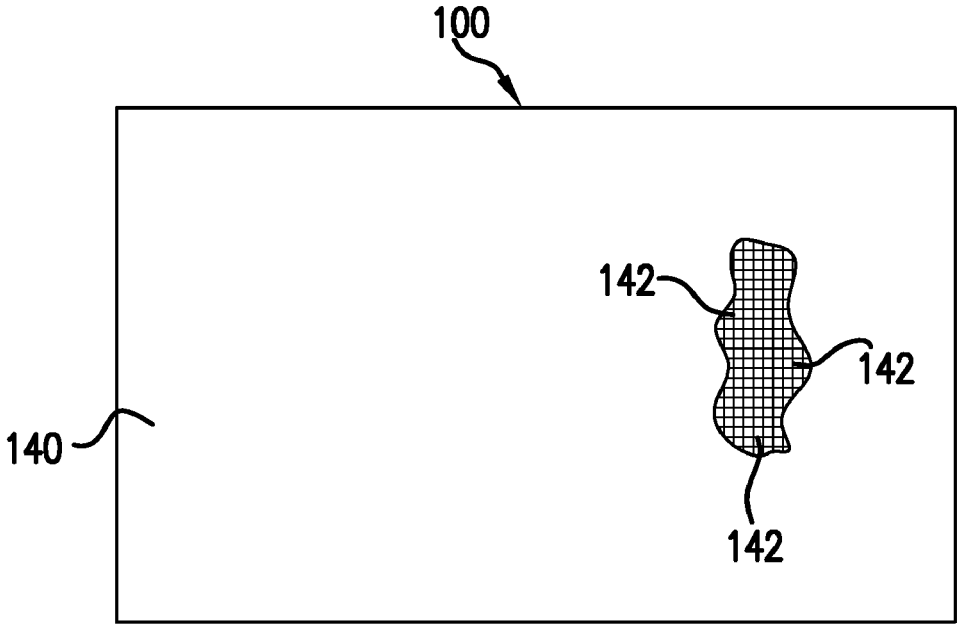
FIG. 9 is a bottom view of the cover of FIG. 7.

Referring now to FIG. 9, the first bottom surface 140 of the cover 100 is shown as being comprised of fibrous strands 142.

Figure 10:
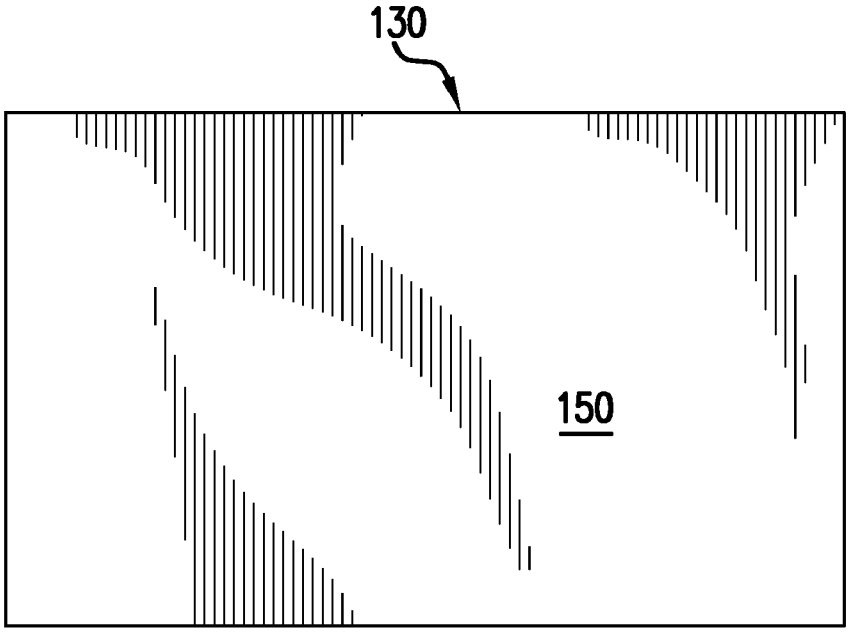
FIG. 10 is a bottom view of the mat of FIG. 8.
Figure 11:
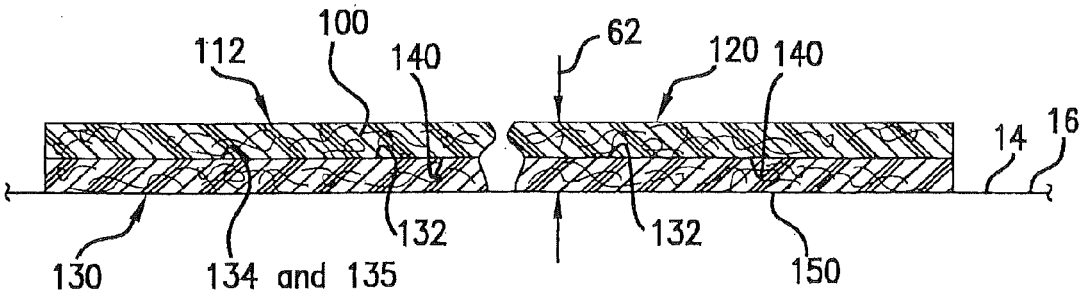
FIG. 11 is a side elevation view of the rug of FIG. 7 showing force applied to the rug by a footstep.
Figure 12:
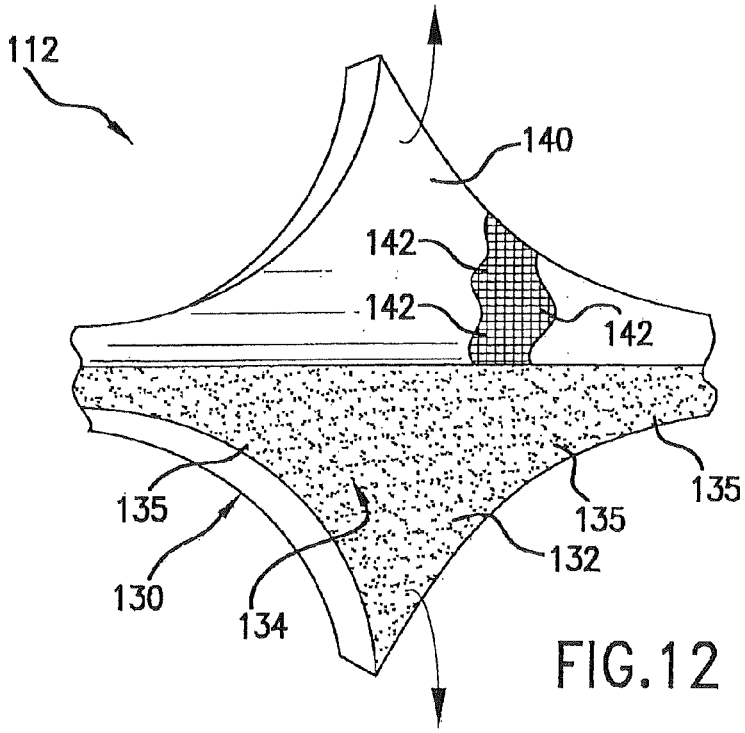
FIG. 12 is a side perspective view of the rug as the cover is stripped from the mat.

FIG. 10 illustrates the second bottom surface 150 of the mat 130. Bottom surface 150 engages the surface 14 of the floor 16 (shown in FIGS. 8 and 9) in a non-slip relationship due to the configuration of and non-slip nature of the material of the mat 130. FIG. 11 shows the rug 112 in cross section with cover 100 overlying mat 130 and FIG. 12 shows the rug 112 with cover 100 partially stripped from mat 130. The first bottom surface 140 of the cover 100 is shown in FIG. 11 in direct overlying contact with the second top surface 132 of the mat 130, and the bottom surface 150 of the mat 130 is shown in direct overlying contact with the surface 14 of the floor 16. As seen in FIGS. 11 and 12, the second top surface 132 of the mat 130 has grit material 134 comprised of particles 135 embedded therein. As seen in FIG. 9, the fibrous strands 142 of cover 100 provide interstices within and therebetween when the strands 142 are engaged and penetrated by the particles 135 (FIGS. 11 and 12) on the second top surface 132 of the mat 130. A substantial number of the particles 135 hook into interstices to provide separation resistance so that the cover 100 must be stripped from the mat 130 (see FIG. 12). The separation resistance is not high enough to prevent manual stripping by a single person grasping the cover 100 in one hand, the mat 130 in the other and pulling the cover 100 and the mat 130 apart as shown in FIG. 12 to apply a stripping force to remove the cover 100 from the mat 130. As indicated by the two un-numbered arrows in FIG. 12, this stripping force applies force vectors transversely of the major dimensions of cover 100 and mat 130.

As is seen in FIG. 11, when the rug 112 is assembled and on the floor 16, foot pressure represented by the arrow 62 is transmitted through the first top surface 120 of the cover 100 and the first bottom surface 140 of the cover 100 to the second top surface 132 of the mat 130. This causes the mat 130 to transmit the foot pressure force 62 to the second bottom surface 150 of the mat 130 so that the second bottom surface 150 of the mat 130 frictionally engages the top surface 14 of the floor 16. Consequently, the mat 130 and the cover 100 prevent slippage of the rug 112 with respect to one another and with respect to the floor 16

When there is no vertical pressure on the rug 112 caused by walking on the rug, or otherwise applying vertical pressure to the first top surface 120 of the cover 100 of the rug 112, the cover 100 and the mat 130 remain aligned when assembled due to the interlocking action of the particles 135 of the grit 134 with the first bottom surface 140 of the cover 100.

It may be desired to switch or replace the cover 100 so as to have a new design for the cover as the seasons change, to provide a room with a fresh look, or to simply replace an old cover with a new cover. This feature is accommodated by having a plurality of interchangeable covers 100 for each mat 130.

In the second embodiment of the invention, the mat 130 is formed of polyester-coated foam with a non-slip material, for example, the polyester may be in the form of a polyester knit. Preferably, the non-slip material is polyvinylchloride disposed on the second top surface 132 (FIG. 8) and second bottom surface 150 (FIG. 10) of the mat 130. In the second embodiment of the invention, the second top surface 132 provided on the mat 130 has the grit material 134 made of the particles 135 dispensed thereon during fabrication of the mat in a manner disclosed in U.S. Pat. No. 4,336,293, incorporated in its entirety by reference. The grit material 134 may be of any grit that has particles 135 which will releasably grip the first bottom surface 140 of the cover 100. A textured or scrim side of the mat 130 is on the second bottom surface 150 (FIG. 10) of the mat 130 so as to be in contact with the surface 14 the floor 16.

FIGS. 13-18

Third Embodiment

Figure 13:
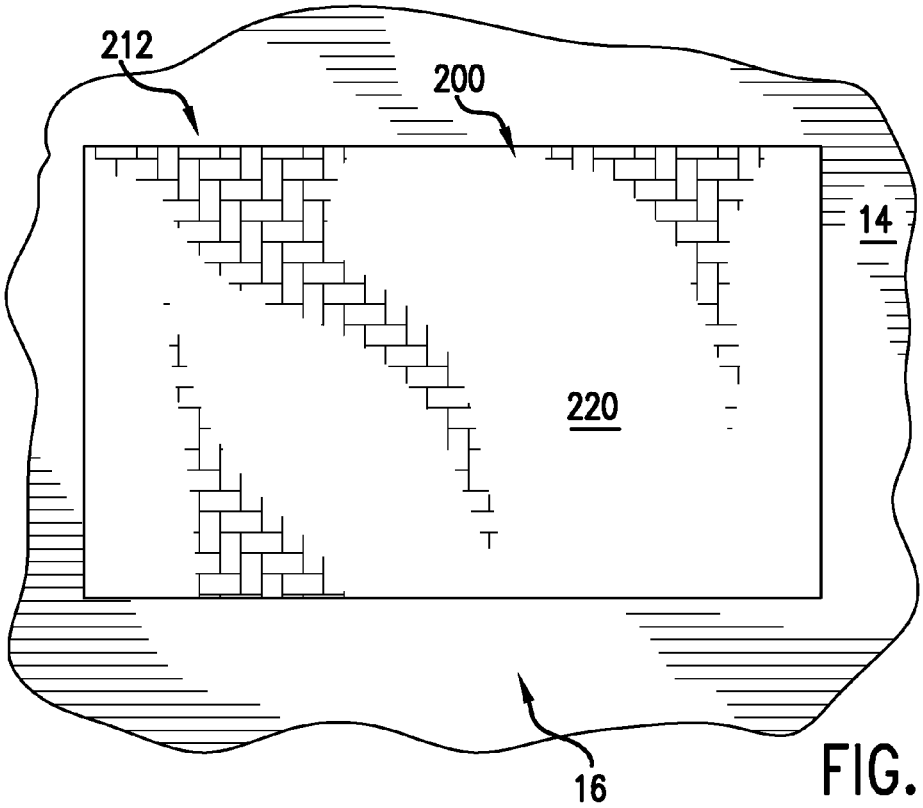
FIG. 13 is a top view of a rug according to a third embodiment of the invention comprising a cover and a mat, with only the cover portion visible and with the rug resting on a floor.

Referring now to FIG. 13 there is shown a cover 200 of a rug 212 lying on the top surface 14 of a floor 16. The cover 200 provides a first top surface 220 when it lies on the surface 14 of the floor 16. The first top surface 220 may be decorative, as is the case in almost all rugs or mats which serve as carpets in homes, offices and other buildings. The first top surface 220 of the rug 212 may also be utilitarian when used for bath mats, kitchen mats, exercise mats, pet mats, yoga mats or any other kind of mat.

Figure 14:
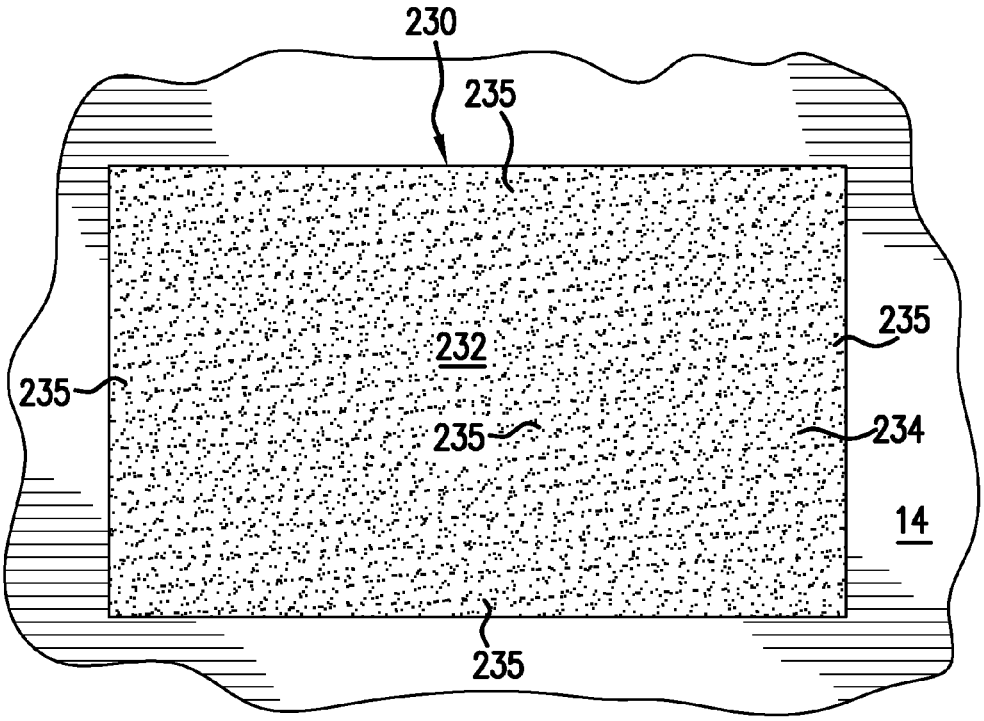
FIG. 14 is a top view of the mat of the rug of FIG. 13, the mat resting on the floor with the cover stripped from the mat.

Referring now to FIG. 14, a mat 230 having a second top surface 232 is shown with the cover 200 of FIG. 13 removed by being stripped therefrom. The mat 230 rests directly on the surface 14 of the floor 16 and is made of flexible resilient material or materials that provide non-slip characteristics with respect to both the surface 14 of the floor 16 and the cover 200. The second stop surface 232 of the mat 230 has a flexible plastic or resinous material 234 with microscopic projections 235 thereon to provide a mechanical gripping texture to the resinous material for mechanically engaging the first bottom surface 240 of the cover 200 to prevent the cover 200 from slipping with respect to the second top surface 232 of the mat 230.

Figure 15:
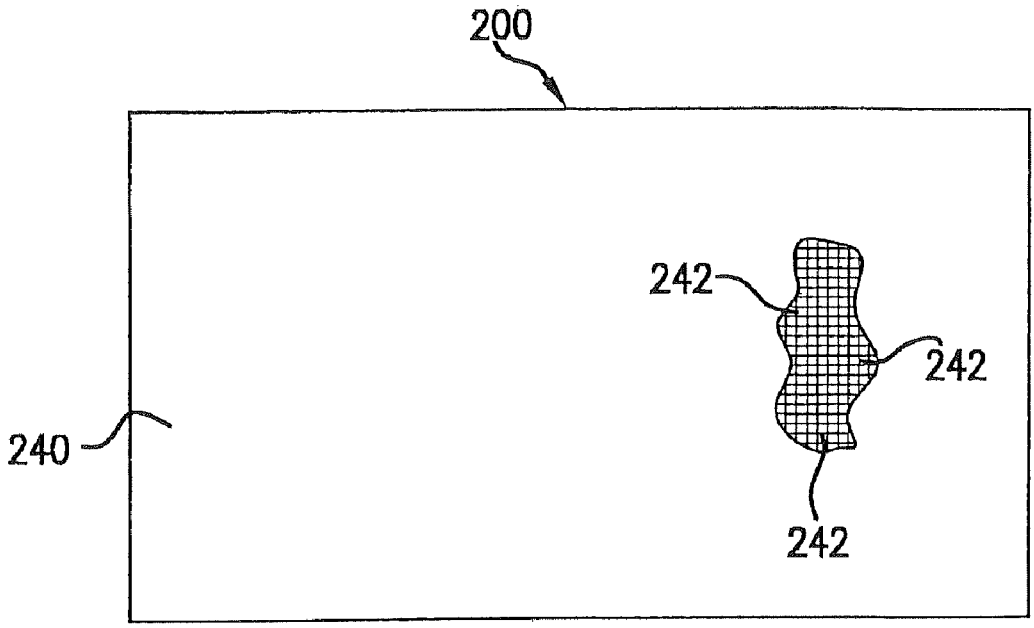
FIG. 15 is a bottom view of the cover portion of FIG. 13.
Figure 18:
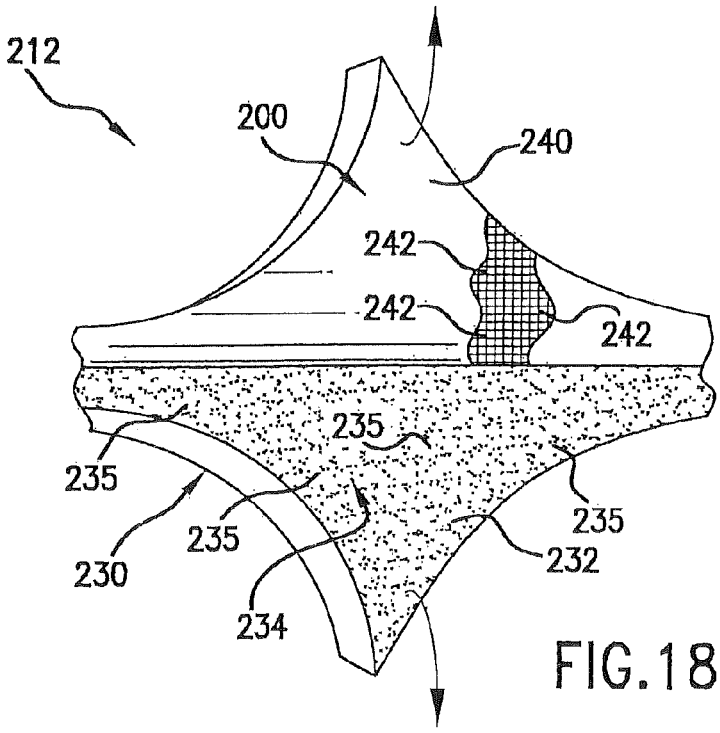
FIG. 18 is a side perspective view of the rug of FIG. 13 as the cover is stripped from the mat.

Referring now to FIG. 15, the first bottom surface 240 of the cover 200 is shown as being comprised of fibrous strands 242. The fibrous strands 242 provide interstices within and therebetween when the strands are engaged and penetrated by the projections 235 on the second top surface 232 of the mat 230. A substantial number of the projections 235 penetrate into interstices to provide separation resistance so that the cover 200 must be stripped from the mat 230 (see FIG. 18). The separation resistance is not high enough to prevent manual stripping by a single person grasping the cover 200 in one hand, the mat 230 in the other and pulling the cover 200 and mat 230 apart as shown in FIG. 18.

The flexible plastic or resinous material 234 is either in the form of a film or a secondary layer which is glued, bonded or otherwise adhered directly to the second top surface 232 of the mat 230 or in the form of a coating which is applied directly to and then cured or dried upon the second top surface 232 of the mat 230. In a preferred embodiment it is a film coated with a high-melt temperature resinous material having a resinous pattern thereon, for example, a honeycomb pattern, with microscopic projections that interlock with the first bottom surface 240 of the cover 200.

Figure 16:
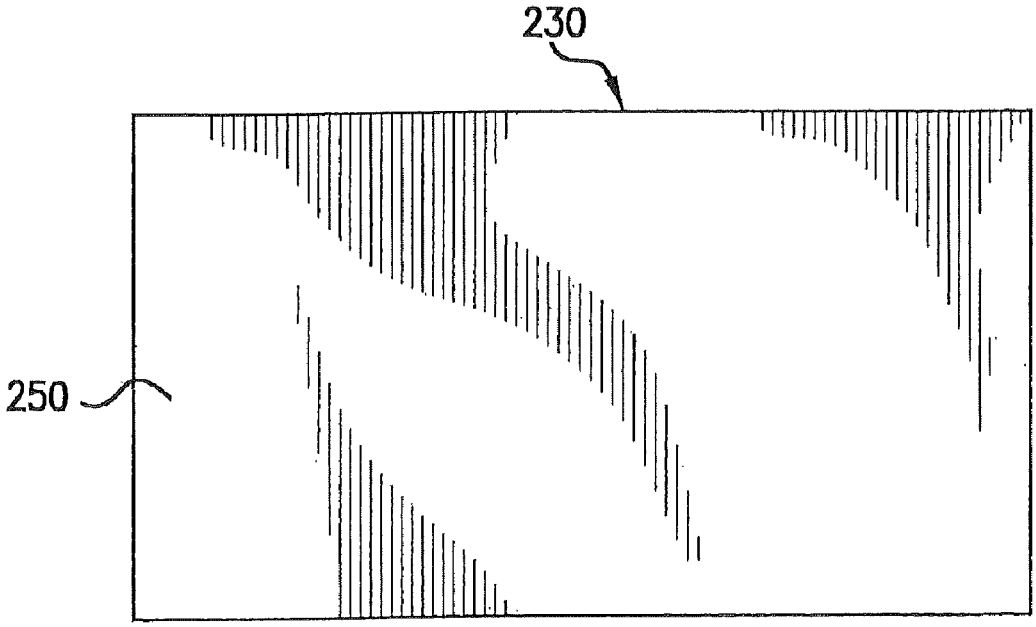
FIG. 16 is a bottom view of the mat of FIG. 14.

FIG. 16 illustrates the second bottom surface 250 of the mat 230 which engages the surface 14 of the floor 16 (shown in FIG. 8) in a non-slip relationship due to the configuration of and non-slip nature of the material of the mat 230.

Figure 17:
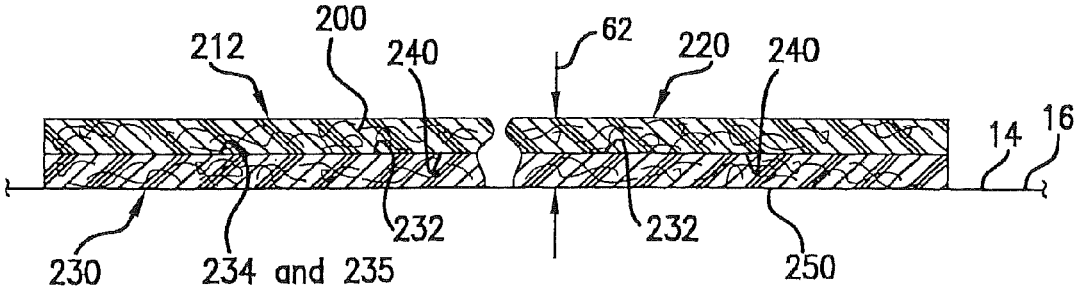
FIG. 17 is a side elevation view of the rug of FIG. 13 showing force applied by a footstep.

As is seen in FIG. 17, where the rug 212 is shown in cross-section, it is seen that when the rug 212 is assembled and on the floor 16, foot pressure represented by the arrow 62 is transmitted through the first top surface 220 of the cover 200 and the first bottom surface 240 of the cover 200 to the second top surface 232 of the mat 230. This causes the mat 230 to transmit the foot pressure force 62 to the second bottom surface 250 of the mat 230 so that the second bottom surface 250 of the mat 230 frictionally engages the top surface 14 of the floor 16. Consequently, the mat 230 and the cover 200 prevent slippage of the rug 212 with respect to one another and with respect to the floor 16.

When there is no vertical pressure on the rug 212 caused by walking on the rug, or otherwise applying vertical pressure to the first top surface 220 of the cover 200 of the rug 212, the cover 200 and the mat 230 remain aligned when assembled due to the interlocking action of the projections 235 on the second top surface 232, engaging with the first bottom surface 240 of the cover 200.

It may be desired to switch or replace the cover 200 so as to have a new design for the covers as the seasons change, to provide a room with a fresh look, or to simply replace an old cover with a new cover. This feature is accommodated by having a plurality of interchangeable covers 200 for each mat 230.

The mat 230 is formed of polyester-coated foam with a non-slip material, for example, the polyester may be in the form of a polyester knit. Preferably, the non-slip material is polyvinylchloride disposed on the second top surface 232 (FIG. 14) and second bottom surface 250 (FIG. 16) of the mat 230. In yet another embodiment of the invention, the second top surface 232 provided on the mat 230 has the resinous material 234 made of the projections 235 dispensed thereon during fabrication of the mat either in the form of a resinous sheet or film adhered to the mat 230 or fluid or particulate deposits made on the second top surface 232 of the mat 230 and allowed or otherwise caused to cure into a solid state.

The plastic or resinous material 234 has a resinous pattern thereon, preferably a honeycomb pattern, giving the surface a texture which engages the fabric of the cover 200 to releasably retain the cover 200 on the mat 230 in a non-slip relationship with sufficient force to require stripping of the cover 200 from the mat 230 by gripping the cover 200 and gripping the mat 230 and pulling the cover 200 and mat 230 apart.

Figure 19:
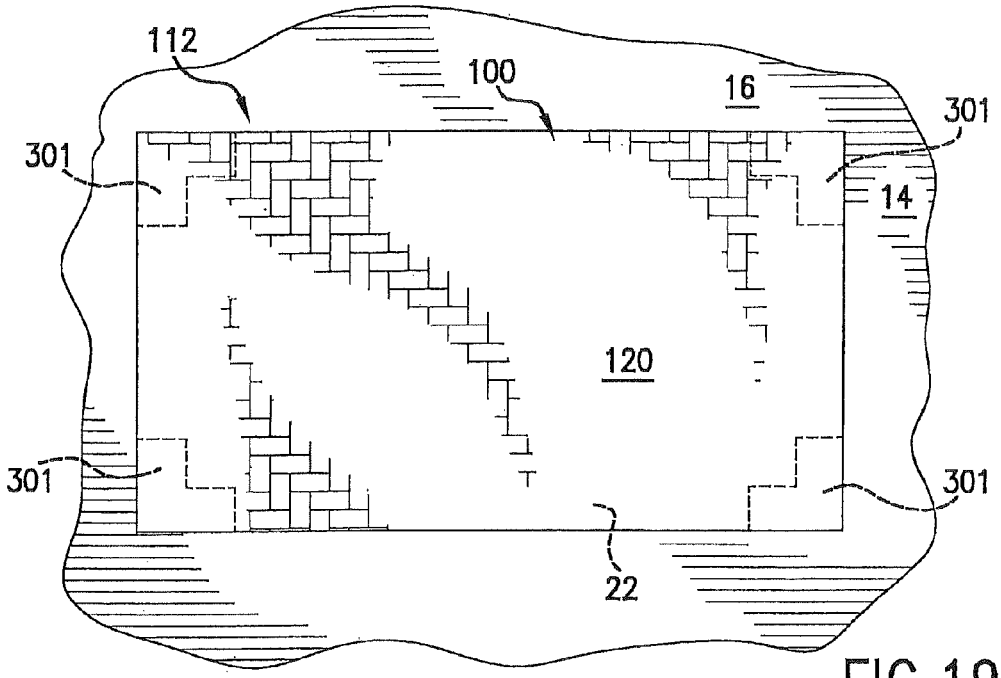
FIG. 19 is a top view of a rug according to a fourth embodiment of the invention comprising a cover portion and a mat, with only the cover portion visible and with the rug resting on a floor.
Figure 20:
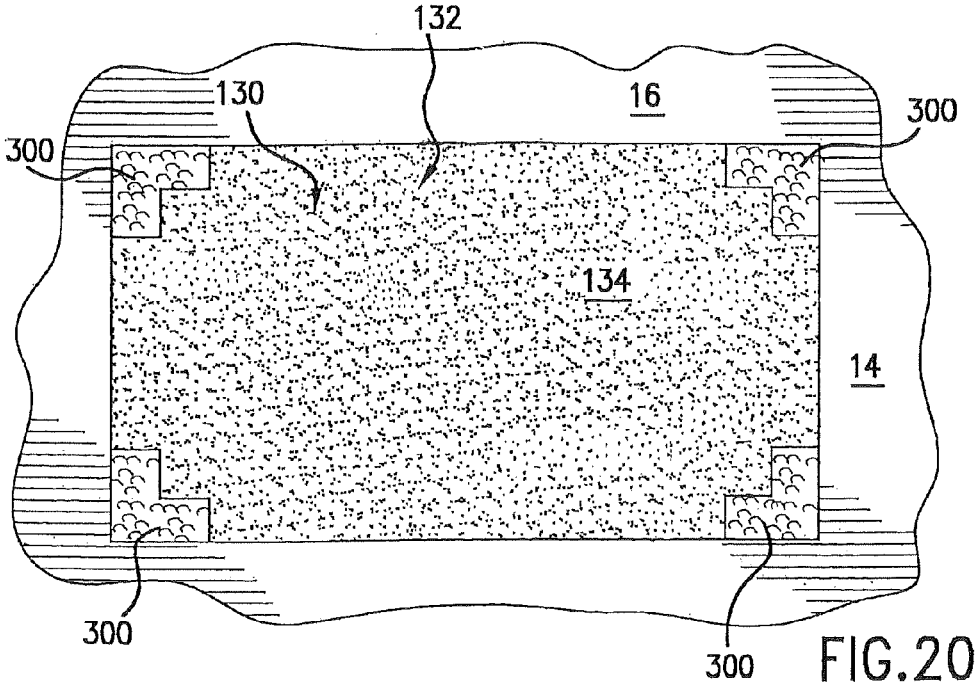
FIG. 20 is a top view of the mat of the rug of FIG. 19, the mat resting on the floor with the cover stripped from the mat.

FIGS. 19 and 20

Fourth Embodiment

In the fourth embodiment of the invention, either the second or third embodiments, which use grit 134 or projections 235 for attachment of the cover 100 or 200 to the mat 130 or 230, respectively, may be modified to further have patches 300 (on the second top surface 132 of mat 130) and 301 (on the first bottom surface 140 of the cover 100) of a hook and loop material of the type sold under the trademark VELCRO to secure the peripheries of the cover of FIG. 19 and the mat of FIG. 20 one to another. In FIGS. 19 and 20, patches 300 have loops and patches 301 have hooks and the rug of the second embodiment (FIGS. 7-12) is used to illustrate the modification.

With respect to the first through fourth embodiments of the rugs with a mat portion, while polyester is the preferred material for the mats 30, 130, and 230, an eco-friendly material that is soybean-based may be used rather than a petroleum-based plastic, or natural rubber, or any other new material with similar attributes.

While a plethora of materials may be used for the covers 10, 100 and 200, a presently preferable cover has a fiber content which is substantially polyester which on the first top surface of the cover is coated with polypropylene so as to be, non-toxic, non-bleed and stain resistant. The bottom surface of the cover has a polypropylene coating which makes the fabric stronger. In the second, third and fourth embodiments, the polypropylene coating is penetrated by the particles 135 comprising the grit material 134 or comprising the projections 235 comprising the resinous material 234 to form mechanical interlocking therewith, which releasably attaches the covers 100 and 200 to the mats.

From the foregoing description, one skilled in the art can easily ascertain the essential characteristics of this invention, and without departing from the spirit and scope thereof, can make various changes and modifications of the invention to adapt it to various usages and conditions.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications cited herein, and of corresponding U.S. Provisional Application Ser. No. 61/252,859, filed Oct. 19, 2009, are incorporated by reference herein.

The preceding embodiments are illustrative and not limiting of the scope of the invention.

We claim:

1. A rug for placement on a floor, the rug comprising: a cover having a cover top surface and a cover bottom surface, the cover bottom surface having a cover peripheral area and a cover central area; a mat having a mat top surface and a mat bottom surface, the mat top and mat bottom surfaces being substantially planar, the mat top surface having a mat peripheral area and a mat central area, the mat bottom surface exposing non-slip material for frictionally gripping and that portion of the surface of such floor covered by the mat, a peripheral fastening material secured to the cover bottom surface in the cover peripheral area, and a peripheral fastening material secured to the mat top surface in the mat peripheral area, the peripheral fastening material on the cover engaging the peripheral fastening material on the mat for detachably connecting the peripheral area of the cover to the peripheral area of the mat with a holding force operative to keep the cover and the mat connected in an overlying relationship and to prevent the cover slipping relative to the mat, until it is desired to separate the cover and mat, the cover being removable from the mat by applying to the cover a stripping force transversely to the respective surfaces of the mat and the cover to separate the cover from the mat.

2. A rug for placement on a floor, the rug comprising: a cover comprising a polyester fabric and having a top surface and a bottom surface each coated with polypropylene, the bottom surface of the cover having a peripheral area and a central area; a mat having a top surface and a bottom surface, the top and bottom surfaces of the mat being substantially planar, the top surface of the mat having a peripheral area and a central area, the bottom surface of the mat exposing non-slip material for frictionally gripping that portion of the surface of such floor covered by the mat; a peripheral fastening material secured to the peripheral area of the mat for detachably connecting the peripheral area of the cover to the peripheral area of the mat with a holding force operative to keep the cover and the mat connected in an overlying relationship and to prevent the cover from slipping relative to the mat, until it is desired to separate the cover and mat, the cover being removable from the mat by applying to the cover a stripping force transversely to the respective surfaces of the cover and the mat to separate the cover from the mat.

3. A rug for placement on a floor, the rug comprising:

a cover having a cover top surface and a cover bottom surface;

a mat having a mat top surface for facing the cover bottom surface and a non-slip mat bottom surface for facing such floor; the cover bottom surface and the mat top surface each having thereon a respective releasable fastening material for contact with each other to releasably attach the cover to the mat and to prevent the cover from slipping relative to the mat, the cover being manually strippable from the mat by applying thereto a stripping force transversely to the respective surfaces of the cover and the mat.

4. The rug according to claim 3 wherein the releasable fastening material comprises hook material on one of the bottom surface of the cover and the top surface of the mat and loop material on the other of the bottom surface of the cover and the top surface of the mat.

5. The rug according to claim 3 wherein the releasable fastening material comprises grippable material on one of the bottom surface of the cover and the top surface of the mat and gripping elements on the other of the bottom surface of the cover and the top surface of the mat.

6. The rug according to claim 3 wherein the releasable fastening material is a resinous material having a mechanical gripping texture, the material being applied directly to both the top surface and the bottom surface of the mat.

7. The rug according to claim 6, wherein the top surface of the mat comprises a plastic film with outwardly projecting microscopic projections, and the plastic film is directly adhered to the top surface of the mat.

8. The rug according to claim 6, wherein the resinous material is dispersed onto the mat in fluid or particulate form and cured.

9. The rug according to claim 6, wherein the mat comprises a plastic film that is directly adhered to the top surface of the mat and has a resinous pattern thereon.

10. The rug according to claim 3 wherein the mat is non-absorbent.

11. The rug according to claim 3 wherein the bottom surface of the cover is mechanically interlocked with the top surface of the mat by the releasable fastening material.

12. The rug according to claim 1 or claim 3 wherein respective ones of the releasable fastening material comprise an integral part of the bottom surface of the cover and an integral part of the top surface of the mat.

13. The rug according to claim 3 wherein respective ones of the releasable fastening material are disposed on substantially the entire cover bottom surface and on substantially the entire mat top surface.

14. The rug according to claim 1, claim 2 or claim 3 wherein the cover bottom surface has a peripheral cover area and a central cover area, the releasable fastening material on the cover bottom surface is concentrated in the peripheral cover area relative to the central cover area, the mat top surface has a peripheral mat area and a central mat area, and the releasable fastening material on the mat top surface is concentrated in the peripheral mat area relative to the central mat area.

* * * * *